US010695780B2

(12) United States Patent
Ki et al.

(10) Patent No.: US 10,695,780 B2
(45) Date of Patent: Jun. 30, 2020

(54) LIQUID DISCHARGING VESSEL

(71) Applicant: YONWOO CO., LTD., Incheon (KR)

(72) Inventors: Joong Hyun Ki, Incheon (KR); Yu Seob Kim, Incheon (KR); Seo Hui Jung, Incheon (KR); Hyo Sun Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 15/985,385

(22) Filed: May 21, 2018

(65) Prior Publication Data

US 2019/0283056 A1 Sep. 19, 2019

(30) Foreign Application Priority Data

Mar. 16, 2018 (KR) ..... 10-2018-0030931

(51) Int. Cl.

| | |
|---|---|
| ***B05B 11/00*** | (2006.01) |
| ***A45D 34/04*** | (2006.01) |
| ***A45D 34/00*** | (2006.01) |
| ***B65D 47/28*** | (2006.01) |
| ***B65D 83/28*** | (2006.01) |
| ***B65D 83/30*** | (2006.01) |
| ***B05B 11/04*** | (2006.01) |
| ***B65D 47/42*** | (2006.01) |

(52) U.S. Cl.

CPC ..... *B05B 11/0091* (2013.01); *A45D 34/00* (2013.01); *A45D 34/04* (2013.01); *A45D 34/043* (2013.01); *B05B 11/0027* (2013.01); *B05B 11/0032* (2013.01); *B05B 11/047* (2013.01); *B05B 11/3015* (2013.01); *B05B 11/3053* (2013.01); *B65D 47/28* (2013.01); *B65D 47/42* (2013.01); *B65D 83/285* (2013.01); *B65D 83/303* (2013.01); *A45D 2034/002* (2013.01); *A45D 2200/054* (2013.01); *A45D 2200/056* (2013.01); *A45D 2200/057* (2013.01); *B05B 11/3023* (2013.01); *B05B 11/3069* (2013.01)

(58) Field of Classification Search

CPC .... A45D 34/00; A45D 34/005; A45D 34/007; A45D 34/04; A45D 34/041; A45D 40/26; A46B 11/0006; B65D 47/061; B65D 47/247

USPC ..... 401/261, 263

See application file for complete search history.

(56) References Cited

U.S. PATENT DOCUMENTS 1,859,108 A * 5/1932 Nadoolman ..... A46B 11/0006 222/183
2,000,910 A * 5/1935 Appel ..... A46B 11/0006 401/151

(Continued)

FOREIGN PATENT DOCUMENTS

EP 1249187 A1 10/2002
JP 2003-19027 A 1/2003

(Continued)

*Primary Examiner* — David P Angwin
*Assistant Examiner* — Bradley S Oliver
(74) *Attorney, Agent, or Firm* — Novick, Kim & Lee, PLLC; Sang Ho Lee

(57) ABSTRACT

Provided is a liquid discharging vessel including: an application tip; and a nozzle exposed upwardly from the application tip by means of an external force and having an outlet adapted to discharge content to top of the application tip, wherein the nozzle moves downwardly from the application tip to close the outlet.

11 Claims, 15 Drawing Sheets

(56) References Cited

U.S. PATENT DOCUMENTS

| | | | | | |
|---|---|---|---|---|---|
| 2,793,792 | A * | 5/1957 | Pilkington | A46B 11/0006 | 222/191 |
| 2,936,935 | A * | 5/1960 | Rabb | B65D 47/247 | 222/525 |
| 3,613,698 | A * | 10/1971 | Fox | A46B 11/0006 | 132/311 |
| 4,717,278 | A * | 1/1988 | Kemeny | A46B 11/0006 | 132/308 |
| 4,787,765 | A * | 11/1988 | Kuo | A46B 11/0006 | 132/311 |
| 5,813,575 | A | 9/1998 | Glynn et al. | | |
| 5,911,532 | A * | 6/1999 | Evancic | A46B 11/002 | 401/190 |
| 9,498,042 | B2 * | 11/2016 | Villarreal | A45D 34/041 | |
| 10,118,189 | B2 * | 11/2018 | Son | A45D 34/00 | |
| 2009/0120963 | A1 * | 5/2009 | Bae | B05B 11/0032 | 222/153.13 |
| 2009/0238632 | A1 | 9/2009 | Carroll et al. | | |
| 2015/0230586 | A1 * | 8/2015 | Thorpe | A45D 40/26 | 401/266 |
| 2016/0324295 | A1 | 11/2016 | Lee | | |

FOREIGN PATENT DOCUMENTS

| | | | |
|---|---|---|---|
| JP | 2009-039509 | A | 2/2009 |
| JP | 2009-136653 | A | 6/2009 |
| JP | 2011-72943 | A | 4/2011 |
| JP | 2011-517588 | A | 6/2011 |
| JP | 2014-521563 | A | 8/2014 |
| JP | 6053346 | B2 | 12/2016 |
| JP | 6178144 | B2 | 8/2017 |
| JP | 2017-164469 | | 9/2017 |
| KR | 10-2016-0038009 | A | 4/2016 |
| WO | 89/11442 | A1 | 11/1989 |
| WO | 2015/108345 | A1 | 7/2015 |
| WO | 2015/137708 | A1 | 9/2015 |
| WO | 2017/043676 | A1 | 3/2017 |

* cited by examiner

LIQUID DISCHARGING VESSEL

CROSS REFERENCE TO RELATED APPLICATION OF THE INVENTION

The present application claims priority to Korean Patent Application No. 10-2018-0030931 filed in the Korean Intellectual Property Office on Mar. 16, 2018, the entire contents of which are incorporated herein by reference.

BACKGROUND OF THE INVENTION

Field of the Invention

The present invention relates to a liquid discharging vessel, and more particularly, to a liquid discharging vessel that is provided with a nozzle that is relatively ascended and descended with respect to an application tip and has an outlet for discharging content stored therein, so that while the application tip is being used, contamination of the content due to introduction of foreign matters into the outlet of the nozzle can be prevented.

Background of the Related Art

Generally, materials like cosmetics, pharmaceuticals, and so on are stored in vessels having various shapes according to their purposes, ingredients, and viscosity. For example, if such material is liquid and has relative high viscosity, it is stored in a tube-shaped vessel or a pumping vessel.

At this time, the tube-shaped vessel has an outlet, and it is compressed by a user's hand to discharge a small quantity of content from the outlet, so that the discharged content is transferred to the user's application portion.

Contrarily, the pumping vessel also has an outlet, and if a button located on the pumping vessel is pressed by the user, content is discharged from the outlet and is then consumed.

Unlike the above-mentioned application manners, the outlet itself of the tube-shaped vessel or the pumping vessel comes into direct contact with the user's application portion, and for example, an application tip is disposed on the outlet of the vessel, so that the application tip to which the content is discharged rubs against the user's application portion to allow the content to be transferred to the user.

At this time, the application tip may be made of various materials according to the use purposes and functions of the content, and for example, the application tip is made of synthetic resin. Further, the application tip is made of rubber so as to provide soft touch, or it is made of metal so as to provide cool touch.

By the way, the conventional vessel having the application tip has the outlet formed on top of the application tip, and in a process where the application tip rubs against the user's application portion, accordingly, foreign matters may be introduced into the outlet formed on the application tip.

In case of the conventional vessel, advantageously, there is no need to transfer the content to the user's hand, but as the outlet formed on top of the application tip is exposed to the outside, the content may be contaminated.

SUMMARY OF THE INVENTION

Accordingly, the present invention has been made in view of the above-mentioned problems occurring in the prior art, and it is an object of the present invention to provide a liquid discharging vessel that has a nozzle relatively ascended and descended with respect to an application tip and having an outlet for discharging content stored therein, so that as a state where the outlet of the nozzle is always exposed to the outside is avoided, the introduction of foreign matters into the outlet of the nozzle is prevented.

It is another object of the present invention to provide a liquid discharging vessel that is capable of transferring content stored therein and at the same time performing skin massage, through an application tip, and that does not allow an outlet for discharging the content to be exposed to the outside above top of the application tip, so that contamination of the content is prevented and the top of the application tip is kept clean.

To accomplish the above-mentioned objects, according to the present invention, there is provided a liquid discharging vessel including: an application tip; and a nozzle exposed upwardly from the application tip by means of an external force and having an outlet adapted to discharge content to top of the application tip, wherein the nozzle moves downwardly from the application tip to close the outlet.

According to the present invention, desirably, the nozzle includes a handle protruding outwardly therefrom to help the nozzle ascended.

According to the present invention, desirably, the nozzle includes a depressed portion formed on the external surface thereof to seat a user's finger thereonto.

According to the present invention, desirably, the top of the application tip is a downwardly inclined surface as the top becomes distant from the outlet.

According to the present invention, desirably, the application tip is made of a metal or ceramic material.

According to the present invention, desirably, the liquid discharging vessel further includes: a vessel body open on one side thereof and storing the content; and a shoulder coupled to one side open of the vessel body in such a manner as to seat the application tip thereonto, wherein the nozzle includes a flow path for transferring the content from an interior thereof and having the outlet formed on the end thereof, and the shoulder includes a discharge member for connecting an interior of the vessel body to the flow path of the nozzle.

According to the present invention, desirably, the discharge member includes a discharge hole formed on the underside thereof, and the nozzle includes a valve ascended and descended to open and close a space between the interior of the vessel body and the flow path.

According to the present invention, desirably, the discharge member includes a protrusion formed on the center of the underside thereof and the discharge hole formed around the protrusion, and the valve is hollow in such a manner as to be fitted to the protrusion of the discharge member to allow the interior of the vessel body and the flow path to be isolated from each other, the valve being ascended in such a manner as to be escaped from the protrusion of the discharge member to allow the interior of the vessel body and the flow path to communicate with each other through the discharge hole.

According to the present invention, desirably, the shoulder includes a guide located between the application tip and the nozzle to guide the ascending and descending operations of the nozzle.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
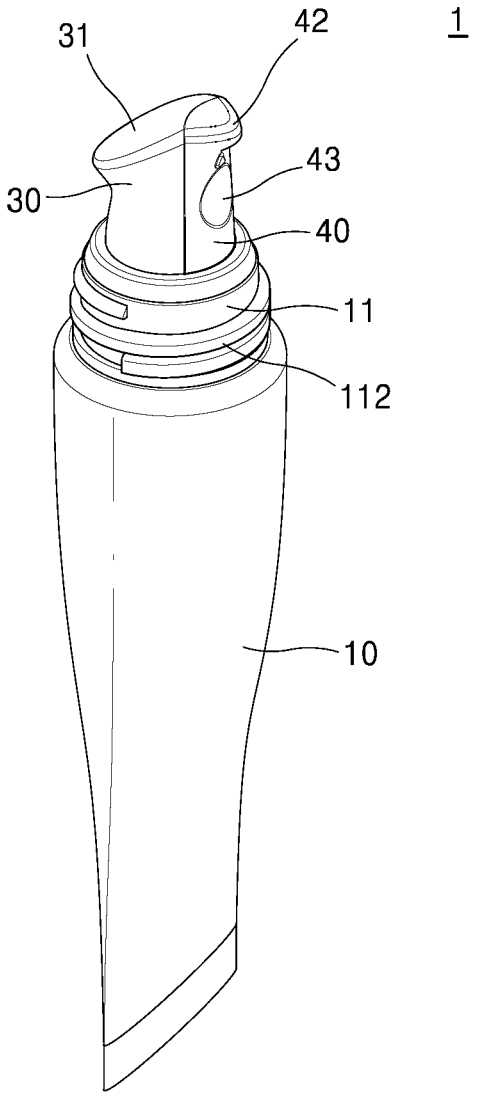
FIG. 1 is a perspective view showing a liquid discharging vessel according to a first embodiment of the present invention.

Objects, characteristics and advantages of the present invention will be more clearly understood from the detailed description as will be described below and the attached drawings. The present invention is disclosed with reference to the attached drawings wherein the corresponding parts in the embodiments of the present invention are indicated by corresponding reference numerals and the repeated explanation on the corresponding parts will be avoided. If it is determined that the detailed explanation on the well known technology related to the present invention makes the scope of the present invention not clear, the explanation will be avoided for the brevity of the description.

Now, an explanation on a liquid discharging vessel according to the present invention will be given with reference to the attached drawings. For your references, content in the present invention is cosmetics, pharmaceuticals, and so on, and of course, it may include all substances dischargeable by means of compression or pumping.

In the description, further, even if components in different embodiments of the present invention are indicated by the same reference numerals as each other, it should be noted that they do not necessarily have the same shapes and structures as each other. In the description, furthermore, upward or downward movements include absolute movements as well as relative movements with respect to another component.

Figure 2:
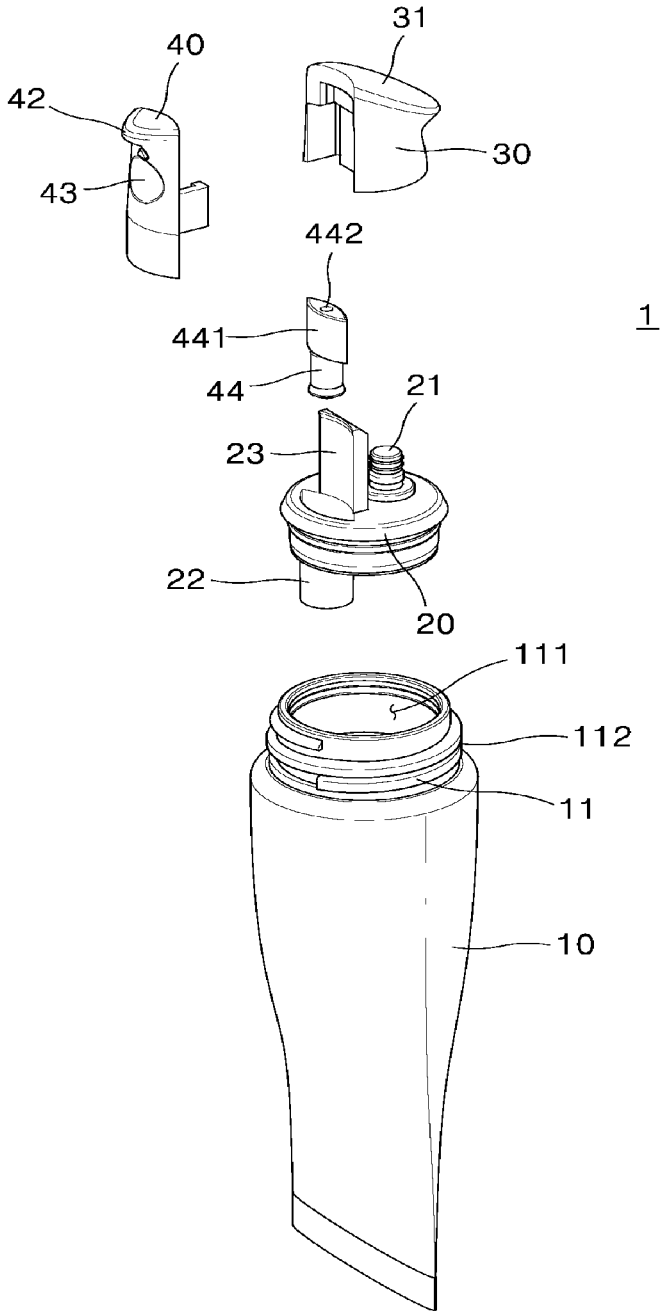
FIG. 2 is an exploded perspective view showing the liquid discharging vessel according to the first embodiment of the present invention.
Figure 3:
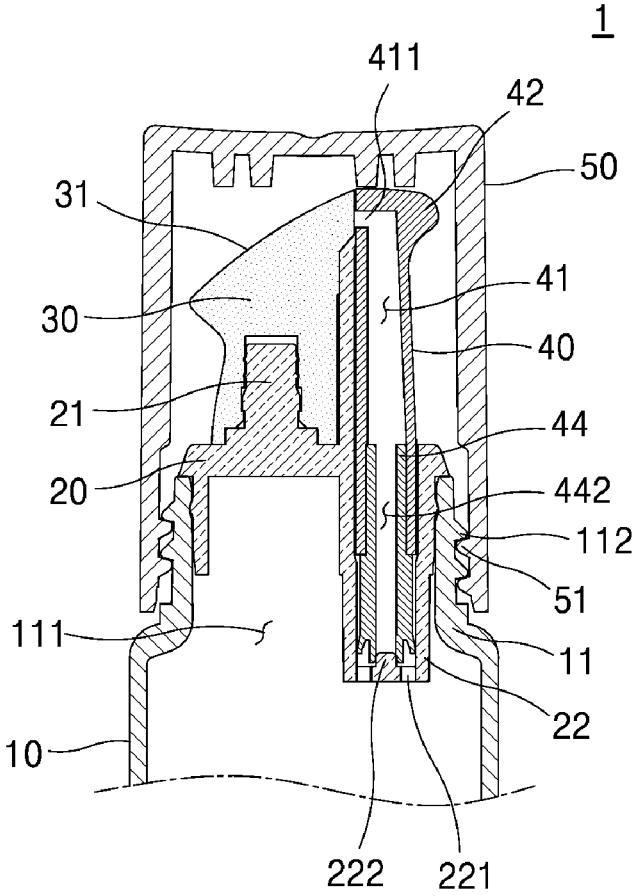
FIG. 3 is a sectional view showing the liquid discharging vessel according to the first embodiment of the present invention.

FIG. 1 is a perspective view showing a liquid discharging vessel according to a first embodiment of the present invention, FIG. 2 is an exploded perspective view showing the liquid discharging vessel according to the first embodiment of the present invention, and FIG. 3 is a sectional view showing the liquid discharging vessel according to the first embodiment of the present invention.

Hereinafter, the liquid discharging vessel according to the first embodiment of the present invention will be in detail explained with reference to FIGS. 1 to 3.

The liquid discharging vessel 1 according to the first embodiment of the present invention largely includes a vessel body 10, a shoulder 20, an application tip 30 and a nozzle 40.

The vessel body 10 stores content and is open on one side thereof. As mentioned above, the content stored in the vessel body 10 is not specially limited in kinds or ingredients. However, the content has high viscosity so that when it is discharged through the nozzle 40, it can be stably seated on top of the application tip 30, without any escape from the application tip 30.

The vessel body 10 may have various shapes, such as a tube, bottle, tottle, pencil, and so on so as to store the content therein. The vessel body 10 is compressed against an external force to discharge the content to one side thereof, and according to the present invention, the vessel body 10 has a shape of a tube, but all kinds of bodies may be adopted only if they discharge the content to one side thereof when the external force is applied to them.

The vessel body 10 has a spout 11 formed on open one side thereof, and the spout 11 is coupled to the shoulder 20 on one side of the vessel body 10. In this case, the spout 11 has an opening 111 formed at the inside thereof to discharge the content to the outside, and the shoulder 20 is then coupled to the opening 111 of the spout 11, so that the content is discharged to the outside through the shoulder 20 coupled to the opening 111 of the spout 11.

The spout 11 has a screw thread 112 formed on the outer peripheral surface thereof. The screw thread 112 of the spout 11 is coupled to a cap 50 as will be discussed later, but if the vessel body 10 and the cap 50 are not screw-coupled to each other, but coupled to each other in other ways, there is no need to form the screw thread 112.

The shoulder 20 is coupled to one side open of the vessel body 10 in such a manner as to allow the application tip 30 to be seated thereonto. The shoulder 20 is inserted into the opening 111 of the spout 11 to seal one side open of the vessel body 10 and has a sleeve (having no reference numeral) extended from the underside thereof in such a manner as to come into close contact with an inner peripheral wall of the opening 111.

The shoulder 20 has a protrusion 21 formed on a top side thereof in such a manner as to be coupled to the application tip 30. The protrusion 21 serves to allow the application tip 30 to be rigidly coupled to the shoulder 20, and of course, if the application tip 30 is coupled to the shoulder 20 by means of bonding, unitary formation, and so on, there is no need to form the protrusion 21 on the shoulder 20.

The shoulder 20 has a discharge member 22 formed on the underside thereof. The discharge member 22 has a shape of a hollow pipe extended inwardly from the shoulder 20 toward the interior of the vessel body 10. The nozzle 40 is ascendably and descendably inserted into the discharge member 22.

The discharge member 22 has a discharge hole 221 formed on the underside as one surface thereof toward the interior of the vessel body 10. The discharge hole 221 is openable and closable by means of the nozzle 40, and when the discharge hole 221 is open, the content is transferred to the outside through a flow path 41 of the nozzle 40. In detail, the discharge member 22 connects the interior of the vessel body 10 to the flow path 41 of the nozzle 40.

In addition to opening and closing the discharge hole 221 itself, at this time, opening and closing may be carried out by allowing the discharge hole 221 and the flow path 41 of the nozzle 40 to communicate with each other or to be blocked from each other.

The discharge member 22 has a protrusion 222 formed inwardly from the center of the underside thereof, and the discharge hole 221 is formed radially around the protrusion 222. At this time, if a valve 44 of the nozzle 40 as will be discussed later is fitted to the protrusion 222, an interior of the valve 44 is isolated from the discharge hole 221, and contrarily, if the valve 44 of the nozzle 40 is escaped from the protrusion 222, the interior of the valve 44 communicates with the discharge hole 221.

That is, the discharge member 22 allows a gap between the discharge hole 221 and the flow path 41 of the nozzle 40 to be open and closed by means of the ascending and descending operations of the valve 44. The discharge hole 221 may be connected to a suction pipe (not shown) toward the internal bottom of the vessel body 10.

The shoulder 20 has a guide 23 located on a top side thereof in such a manner as to be seated between the application tip 30 and the nozzle 40. The guide 23 serves to guide the nozzle 40 relatively ascended and descended with respect to the application tip 30, to prevent the movements of the nozzle 40, and to keep a distance between the nozzle 40 and the application tip 30 to suppress occurrence of unnecessary noise.

The guide 23 is fitted to the nozzle 40 to allow the nozzle 40 to be stably ascended and descended. That is, the nozzle 40 has grasping members (having no reference numerals) adapted to grasp both sides of the guide 23, so that when the nozzle 40 is ascended and descended, the grasping members can move up and down, while placing the guide 23 therebetween. According to the present invention, the formation of the guide 23 prevents the nozzle 40 from unnecessarily moving to left and right sides, while the nozzle 40 is being ascended and descended.

The application tip 30 transfers the content to a user's application portion. At this time, the user's application portion is skin, and the skin includes all regions of a human body such as head skin, lips, and so on.

The application tip 30 has an application surface 31 on which the content is located, and in the state where the content is disposed on the application surface 31, the application surface 31 rubs against the user's application portion, so that the content is transferred to the user's application portion. At this time, the application surface 31 is top of the application tip 30. As the application surface 31 rubs against the user's application portion, the content comes into close contact with the skin and is well transferred to the skin, thereby advantageously improving blood circulation of the skin. Further, rubbing against the user's application portion enables pains caused by the damage of skin or physical impact to be released. In addition, application and massage of the cosmetic content are at the same time carried out, thereby accelerating the absorption of the cosmetic content to the skin, and coolness or warmness may be applied to the skin according to materials of the application surface.

The top of the application tip 30 is an inclined surface, and for example, as shown, it is inclined downwardly as it is distant from an outlet 411 of the nozzle 40. In this case, the content discharged from the outlet 411 of the nozzle 40 is located on the top of the application tip 30, and as time passes, it flows along the top inclined. However, of course, the moving speed of the content may be varied according to the viscosity of the content.

The application tip 30 is made of a soft material for providing soft touch, such as synthetic resin, rubber, silicone, and so on.

Further, the application tip 30 may be made of a material that can be heated or cooled to keep the heated or cooled state during a given period of time. For example, the application tip 30 is made of a metal or ceramic material, and it may be made of a metal like stainless steel so as to ensure sanitation. Of course, the application tip 30 may be made of various materials according to the ingredients, purposes and functions of the content.

The application tip 30 may be made of a material partially containing synthetic resin, rubber, silicone, metal, and ceramic, or a mixture of them.

A part of application tip 30 may comprise synthetic resin, rubber, silicone, metal or ceramic material.

According to the present invention, the outlet 411 is not formed on the top of the application tip 30, but it is located higher than the top of the application tip 30, so that it transfers the content to the top of the application tip 30.

In this case, the content or foreign matters may be simply removed from the top of the application tip 30, so that it can be kept in a clean and sanitary state, thereby advantageously ensuring the user's satisfaction.

The application tip 30 is coupled to the shoulder 20 and is formed depressedly from the interior thereof in such a manner as to be fitted to the protrusion 21 of the shoulder 20. The application tip 30 and the protrusion 21 are coupled to each other by means of forced fitting, protrusion/groove coupling, and so on, and of course, the application tip 30 and the shoulder 20 may be formed unitarily with each other (by means of injection molding, double injection molding, etc.).

Figures 4A, 4B, 4C, 4D:
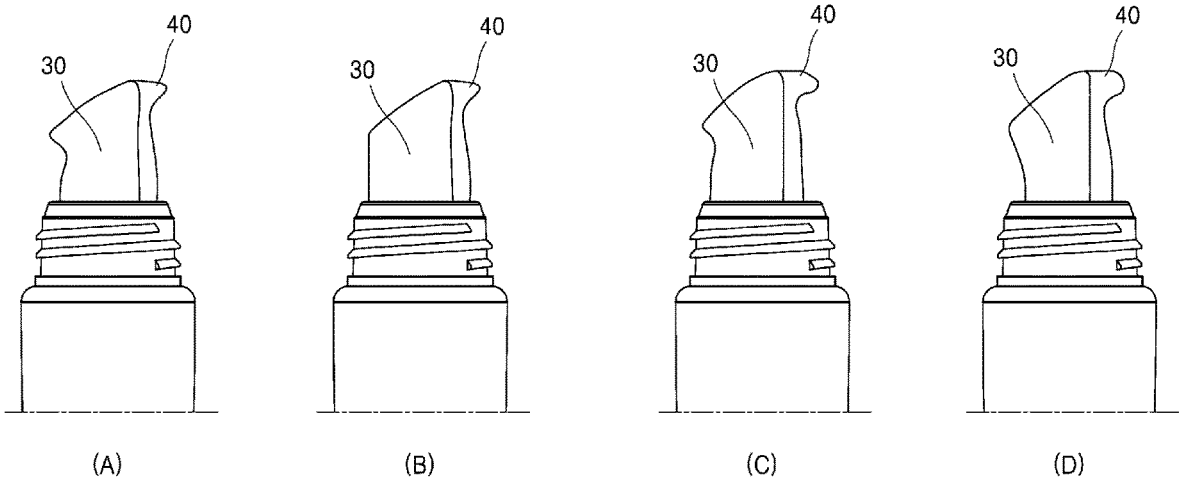
FIGS. 4A to 4D are front views showing various types of liquid discharging vessels according to the first embodiment of the present invention.

As shown in FIGS. 4A to 4D, the application tip 30 may have various shapes. For example, as shown in FIG. 4A, the application tip 30 protrudes from the opposite side to the nozzle 40, and as shown in FIG. 4B, it does not have any protruding portion.

Further, as shown in FIG. 4C or 4D, the application tip 30 is freely changed in shape, and even if the shape of the application tip 30 is changed, in this case, it can ensure the application surface 31 having an appropriate area, thereby increasing use conveniences.

Figure 5:
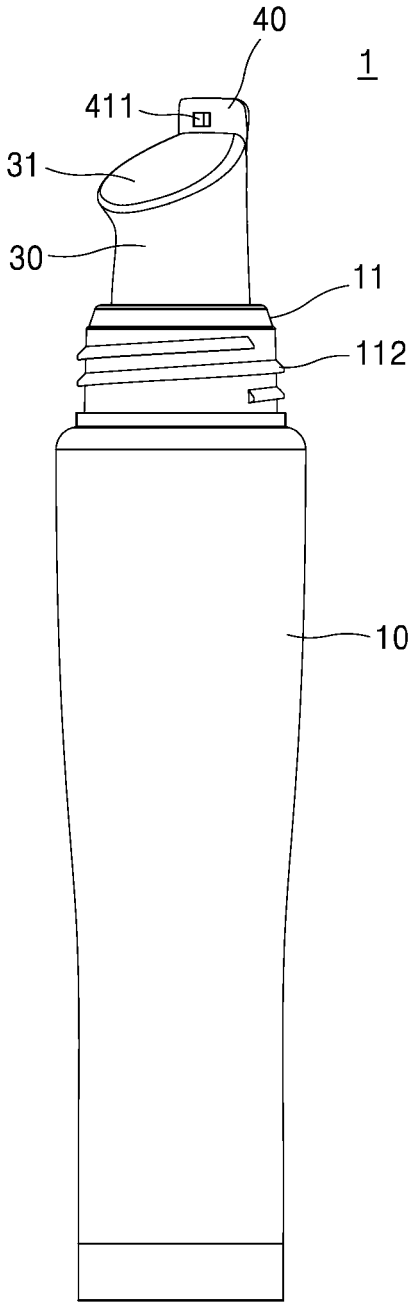
FIG. 5 is a perspective view showing an open state of an outlet in the liquid discharging vessel according to the first embodiment of the present invention.
Figure 6:
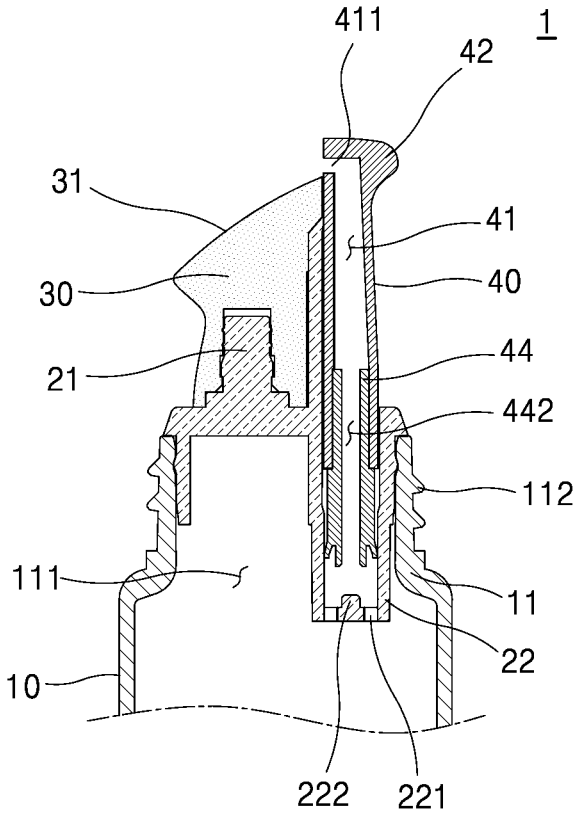
FIG. 6 is a sectional view showing the open state of the outlet in the liquid discharging vessel according to the first embodiment of the present invention.

Now, an explanation on the nozzle 40 will be additionally given with reference to FIGS. 5 and 6.

FIG. 5 is a perspective view showing an open state of the outlet in the liquid discharging vessel according to the first embodiment of the present invention, and FIG. 6 is a sectional view showing the open state of the outlet in the liquid discharging vessel according to the first embodiment of the present invention.

The nozzle 40 protrudes upwardly from the application tip 30 by means of an external force and has the outlet 411 adapted to discharge the content to the top of the application tip 30. In the conventional practice, the content is discharged through the outlet 411 always open, so that foreign matters may enter the outlet 411, thereby undesirably contaminating the content. According to the present invention, only when there is a need to open the outlet 411, the outlet 411 is exposed to the outside through the nozzle 40 ascended and descended.

The nozzle 40 moves downwardly from the application tip 30 to allow the outlet 411 to be closed from the outside. That is, if the nozzle 40 is ascended, the outlet 411 is exposed to the outside, and if the nozzle 40 is descended, the outlet 411 is hidden. At this time, the outlet 411 is closed by means of the application tip 30 or the guide 23.

The nozzle 40 has a handle 42 formed thereon so that it can be conveniently ascended by means of the external force. The handle 42 protrudes outwardly from top of the nozzle 40 and helps the nozzle 40 ascended. According to the shape of the vessel, the handle 42 is formed at an appropriate position capable of helping the nozzle 40 ascended.

As the nozzle 40 is ascended by the user, as shown in FIG. 5, the outlet 411 is open, and at this time, the user's finger is locked onto the handle 42 of the nozzle 40 to allow the nozzle 40 to pull upwardly by his or her finger in a simple manner.

Further, the nozzle 40 has a depressed portion 43 formed on the external surface thereof to allow the user's finger to be seated thereon. The user's finger is locked onto the handle 42 of the nozzle 40, and also, the user's finger is stably seated on the depressed portion 43 of the nozzle 40, so that even with a small force, the nozzle 40 can be ascended and descended, that is, the outlet 411 can be open and closed.

Contrarily, the top of the nozzle 40 pushes downwardly to close the outlet 411, and in this case, also, a large force is not required. Accordingly, the nozzle 40 is descended by the user's finger or the user's application portion.

The nozzle 40 has the flow path 41 adapted to transfer the content from the interior thereof to the user's application portion, and the outlet 411 is formed on the end of the flow path 41. That is, the nozzle 40 has the shape of the hollow pipe having the flow path 41 formed at the interior thereof, and the content flowing along the flow path 41 is transferred to the application surface 31 through the outlet 411.

The flow path 41 is extended in up and down directions with respect to the drawings, and the outlet 411 is extended in left and right directions toward the application surface 31, so that the flow path 41 is bent or curved at least one time on top side of the nozzle 40.

The flow path 41 becomes enlarged toward the lower side thereof from the upper side thereof, and at this time, the valve 44 is fitted to the lower side of the flow path 41. As the valve 44 is ascended and descended, it serves to open and close a space between the interior of the vessel body 10 and the flow path 41.

The valve 44 is hollow and is connected to the lower side of the nozzle 40 or formed unitarily therewith, so that when the nozzle 40 is descended, the valve 44 is fitted to the protrusion 222 of the discharge member 22 to isolate the interior of the vessel body 10 from the flow path 41.

So as to allow the valve 44 to be ascended when the nozzle 40 is ascended, contrarily, the valve 44 has a locking portion 441 formed thereon, and the interior of the nozzle 40 has a structure of limiting a descending operation of the locking portion 411.

Accordingly, the valve 44 is ascended through the ascending operation of the nozzle 40, so that it is escaped from the protrusion 222 of the discharge member 22 and is isolated upwardly to allow the interior of the vessel body 10 and the flow path 41 to communicate with each other by means of the discharge hole 221. Further, the valve 44 has a through hole 442 formed on top thereof in such a manner as to be connected to the flow path 41.

In the state where the nozzle 40 is ascended, accordingly, if the vessel body 10 is pressurized by the user, the vessel body 10 communicates with the flow path 41, thereby discharging the content through the discharge hole 221, the through hole 442 of the valve 44, the flow path 41, and the outlet 411.

Next, an explanation on a use method of the liquid discharging vessel according to the first embodiment of the present invention will be in detail given with reference to FIG. 6.

As shown in FIG. 6, the nozzle 40 is ascended by means of the handle 42 and/or the depressed portion 43 manipulated by the user. In this case, the outlet 411 of the nozzle 40 hidden by the application tip 30 moves from the application tip 30 and is then exposed to the outside.

The outlet 411 of the nozzle 40 exposed to the outside is located above the application surface 31. If the nozzle 40 is ascended, further, the valve 44 of the nozzle 40 is also ascended, and the interior of the valve 44 communicates with the discharge hole 221 of the shoulder 20.

At this time, if the content is discharged through the discharge hole 221 by means of the user's pressurization against the vessel body 10, it is discharged to the application surface 31 through the interior of the valve 44, the through hole 442 of the valve 44, the flow path 41 of the nozzle 40, and the outlet 411.

If the nozzle 40 is descended by the user's finger, after that, the outlet 411 is closed again, and next, the application tip 30 with the content placed on the application surface 31 comes into contact with the user's application portion to apply the content to the application portion. So as to prevent the nozzle 40 from hindering the contact of the application tip 30 with the application portion, at this time, top of the nozzle 40 at the descending position thereof is gently connected with the application surface 31.

According to the present invention, the outlet 411 for discharging the content is not formed on the application tip 30, but formed on the nozzle 40 ascended and descended, so that the application surface 31 is kept clean and it is possible to close the outlet 411, thereby preventing the leakage of the content and protecting the content from foreign matters.

According to the first embodiment of the present invention, the liquid discharging vessel further includes the cap 50. The cap 50 serves to protect the application tip 30 and the nozzle 40 from the outside and specially to keep the nozzle 40 at the descended state thereof, thereby allowing the outlet 411 to be kept closed.

The cap 50 has a screw thread 51 formed on the inner periphery thereof in such a manner as to be coupled to the screw thread 112 of the spout 11, but in addition to the coupling of the screw threads 112 and 51, as mentioned above, the vessel body 10 and the cap 50 may be coupled to each other by means of various structures.

Figure 7:
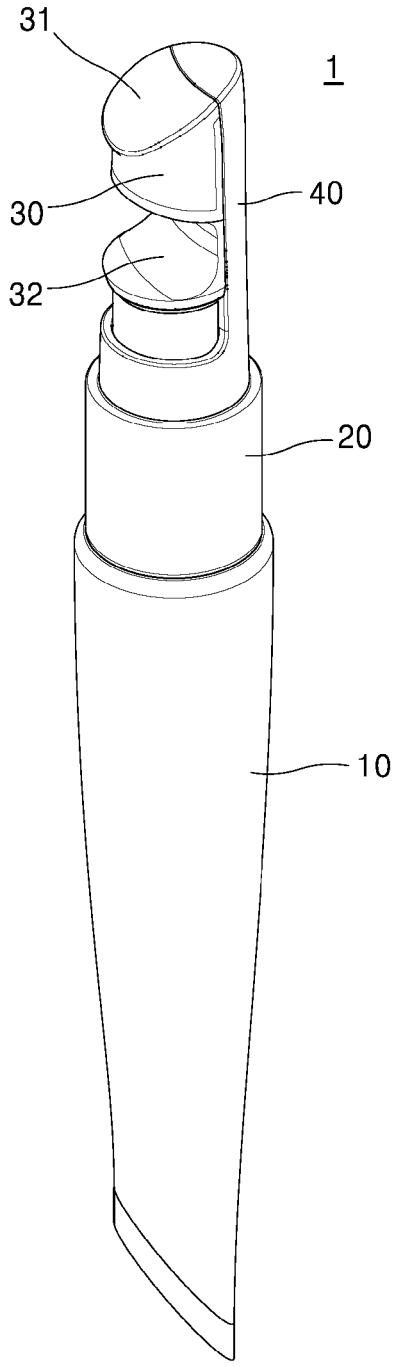
FIG. 7 is a perspective view showing a liquid discharging vessel according to a second embodiment of the present invention.
Figures 8A, 8B, 8C:
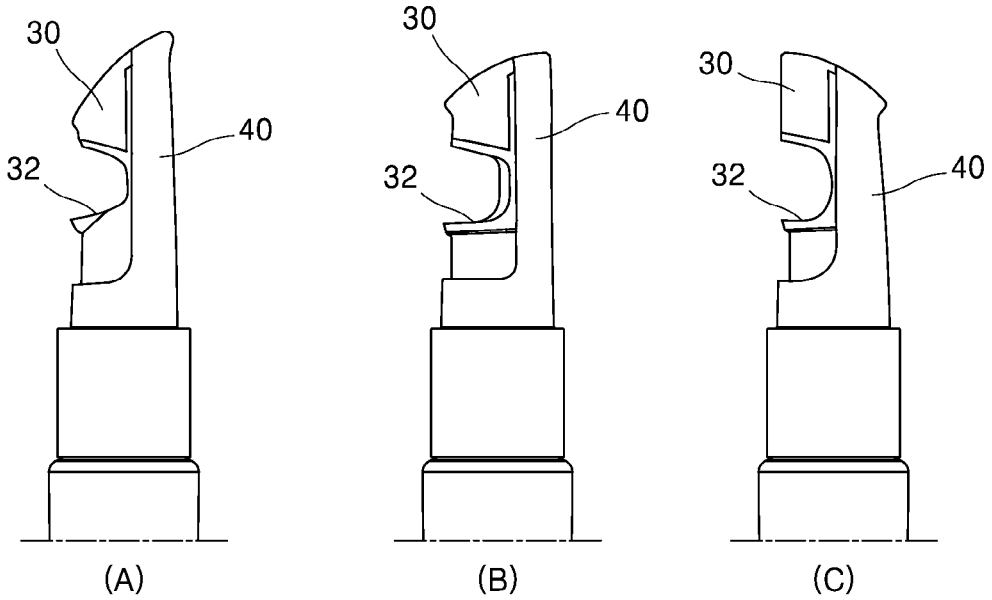
FIGS. 8A to 8C are front views showing various types of liquid discharging vessels according to the second embodiment of the present invention.
Figures 9A, 9B, 9C:
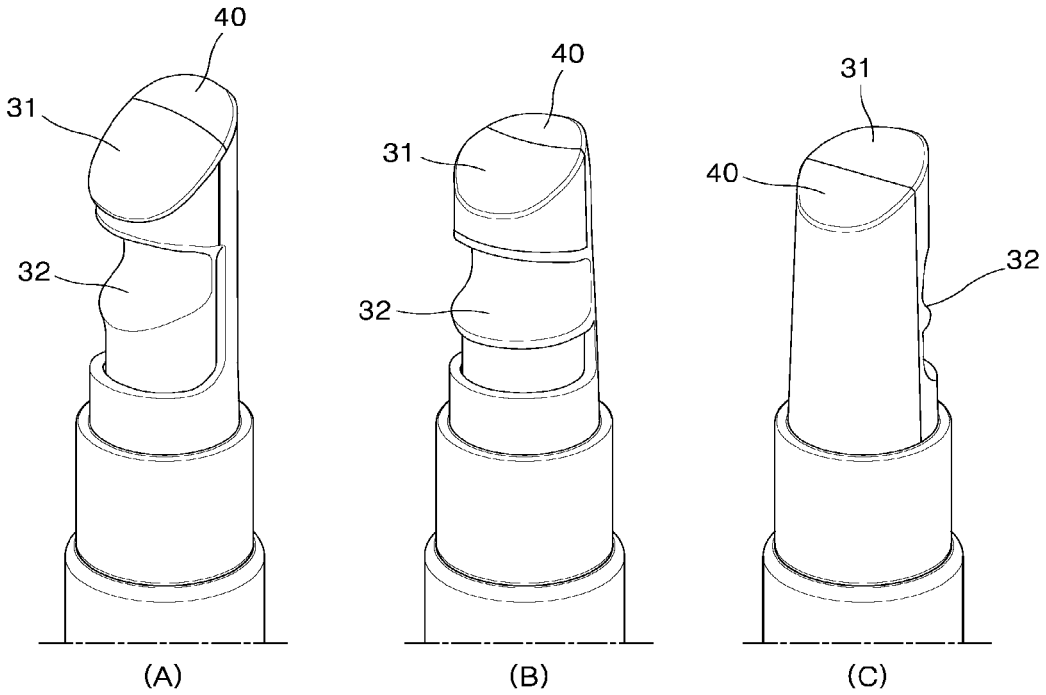
FIGS. 9A to 9C are perspective views showing the various types of liquid discharging vessels according to the second embodiment of the present invention.

FIG. 7 is a perspective view showing a liquid discharging vessel according to a second embodiment of the present invention. FIGS. 8A to 8*c* are front views showing various types of liquid discharging vessels according to the second embodiment of the present invention, and FIGS. 9A to 9C are perspective views showing the various types of liquid discharging vessels according to the second embodiment of the present invention. Hereinafter, different structures of the liquid discharging vessel according to the second embodiment of the present invention from those of the liquid discharging vessel according to the first embodiment of the present invention will be explained, and the structures as not explained below will be replaced with those as mentioned above.

Referring to FIGS. 7 to 9C, unlike the first embodiment of the present invention wherein the nozzle 40 is ascended to allow the outlet 411 to be open, the application tip 30 is descended to allow the outlet 411 to be open. According to the second embodiment of the present invention, that is, the application tip 30 is descended to allow the outlet 411 of the nozzle 40 to be exposed to the outside.

At this time, as shown FIGS. 8A, 8B, 9A and 9B, the application surface 31 as the top of the application tip 30 is inclined downwardly as it is distant from the outlet 411, and otherwise, as shown in FIGS. 8C and 9C, the application surface 31 as the top of the application tip 30 is inclined upwardly as it is distant from the outlet 411.

In case where the application surface 31 is inclined upwardly as it is distant from the outlet 411, even if the content has low viscosity, a discharging direction of the outlet 411 is hidden by the application surface 31 as the top of the application tip 30, so that while the content is being discharged, it cannot be escaped from the application surface 31.

The application tip 30 includes a button 32 formed on the lower side thereof in such a manner as to allow the user's finger to be seated thereon to descend the application tip 30. At this time, the button 32 has a protrusion 321 adapted to couple the application surface 31 thereto, and the protrusion 321 is similar to the protrusion 22, as mentioned above, adapted to couple the shoulder 20 and the nozzle 40 to each other.

Now, an explanation on a detailed structure of the button 32 will be given with reference to FIG. 10.

Figure 10:
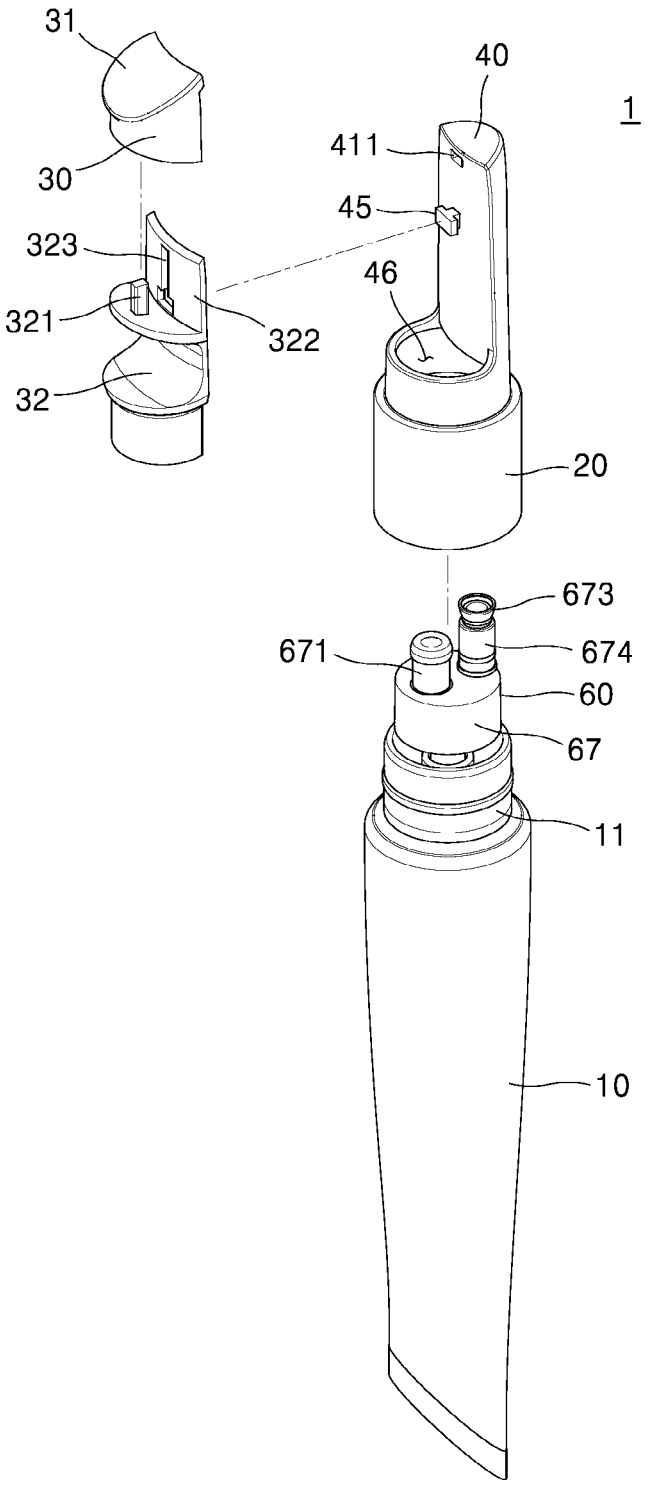
FIG. 10 is an exploded perspective view showing the liquid discharging vessel according to the second embodiment of the present invention.

FIG. 10 is an exploded perspective view showing the liquid discharging vessel according to the second embodiment of the present invention.

As shown in FIG. 10, the button 32 has a guide wall 322 disposed between the application tip 30 and the nozzle 40 to guide relative ascending and descending operations of the nozzle 40 with respect to the application tip 30. According to the second embodiment of the present invention, the application tip 30, not the nozzle 40, is descended, but when the application tip 30 is descended, the nozzle 40 is ascended with respect to the application tip 30. In this case, the guide wall 322 guides the relative ascending or descending operations of the nozzle 40 with respect to the application tip 30.

Further, the button 32 has a guide slot 323 formed on any one of the guide wall 322 and one surface of the nozzle 40 facing the guide wall 322, and a guide protrusion 45 is formed on the other. As shown in FIG. 10, for example, the guide slot 323 is formed on the guide wall 322, and the guide protrusion 45 is formed on the nozzle 40.

At this time, the guide protrusion 45 is inserted into the guide slot 323 to guide the relative ascending and descending operations of the nozzle 40 with respect to the application tip 30. The guide protrusion 45 has a T-shaped section, so that it cannot be escaped from the guide slot 323.

Through the formation of the guide protrusion 45 and the guide slot 323, accordingly, the relative ascending and descending operations of the nozzle 40 with respect to the application tip 30 are stably carried out, and also, the stable descending operation of the button 32 is carried out by an accommodation portion of the nozzle 40.

The nozzle 40 has the accommodation portion adapted to receive the lower side of the button 32, and the accommodation portion serves to allow the button 32 to be stably descended therein and at the same time to allow the descending operation of the button 32 to be restricted therein.

If the button 32 is pressurized to a given depth, that is, the outer side thereof is locked onto the accommodation portion of the nozzle 40 and is not descended anymore. According to the shape of the accommodation portion restricting the descending operation of the button 32, a pumping stroke of a pump 60 as will be discussed later can be determined.

The nozzle 40 has the outlet 411 formed exposed to outside above the application tip 30 to discharge the content to the top of the application tip 30 when the application tip 30 is descended. As the application tip 30 is descended, the outlet 411 of the nozzle 40 is open, and contrarily, as the application tip 30 is ascended, the outlet 411 is closed.

As mentioned above, the nozzle 40 has the guide protrusion 45 adapted to guide the descending operation of the button 32, and also, the nozzle 40 has an accommodation hole 46 adapted to surround the button 32 in such a manner as to guide and restrict the descending operation of the button 32.

Unlike the first embodiment of the present invention, also, the nozzle 40 is formed unitarily with the shoulder 20. According to the second embodiment of the present invention, that is, the shoulder 20 is coupled to one side open of the vessel body 10 in such a manner as to be connected to the nozzle 40, and the application tip 30 is seated ascendably and descendably onto the nozzle 40.

Of course, the shoulder 20 may be coupled to the vessel body 10, and the nozzle 40 may be descended. In the state where the outlet 411 of the nozzle 40 is exposed to the outside by the primary descending operation of the application tip 30, in this case, if the button 32 is pressed again to allow the application tip 30 to be secondarily descended, the nozzle 40 can be descended together with the application tip 30.

Unlike the first embodiment of the present invention, the liquid discharging vessel according to the second embodiment of the present invention further includes the pump 60. According to the second embodiment of the present invention, the content is discharged not by directly pressurizing the vessel body 10, but by the pump 60, and the pump 60 operates through the descending operation of the application tip 30. Now, an explanation on the pump 60 will be in detail given with reference to FIGS. 11 to 12C.

Figure 11:
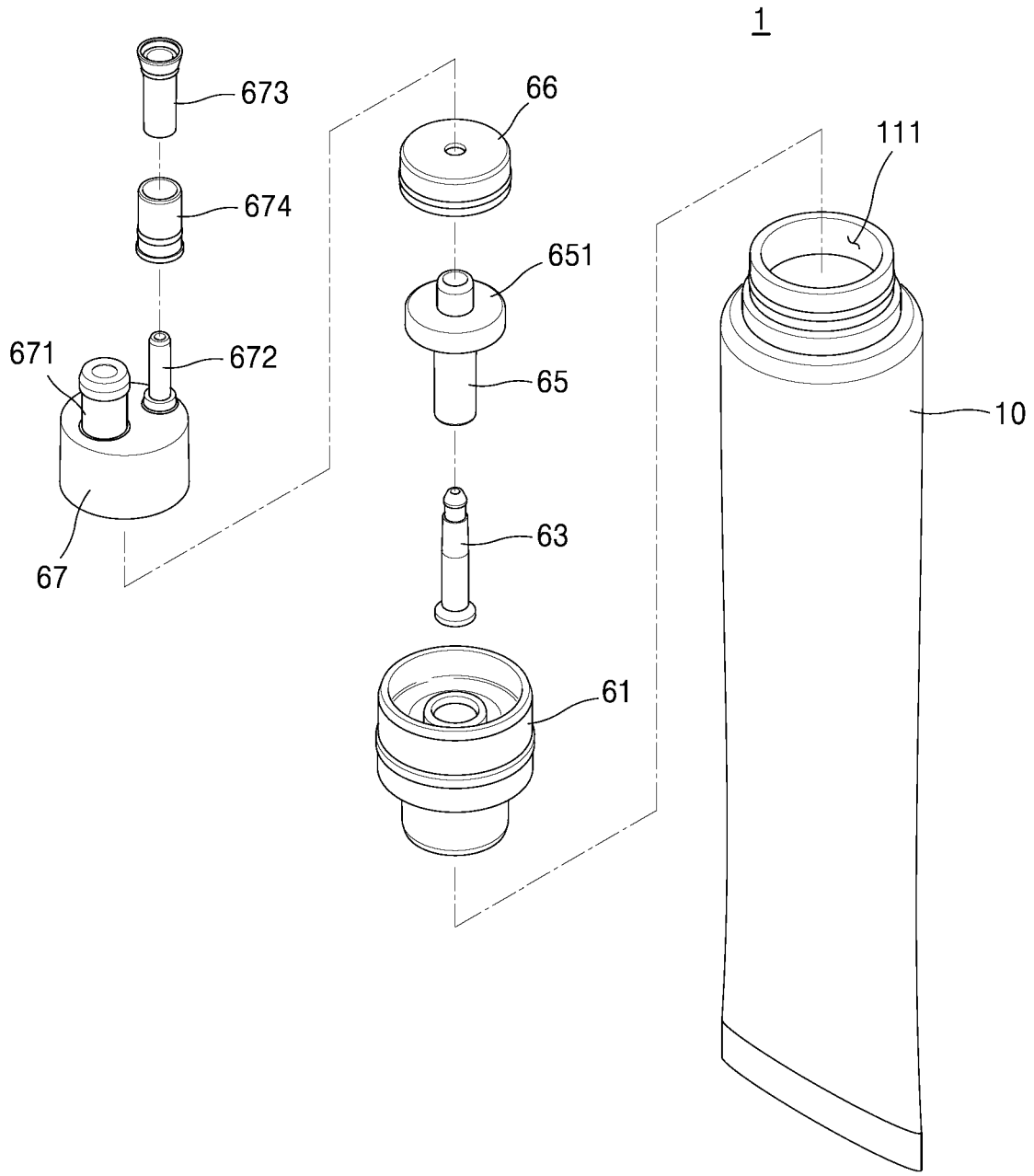
FIG. 11 is a partially exploded perspective view showing the liquid discharging vessel according to the second embodiment of the present invention.
Figures 12A, 12B, 12C:
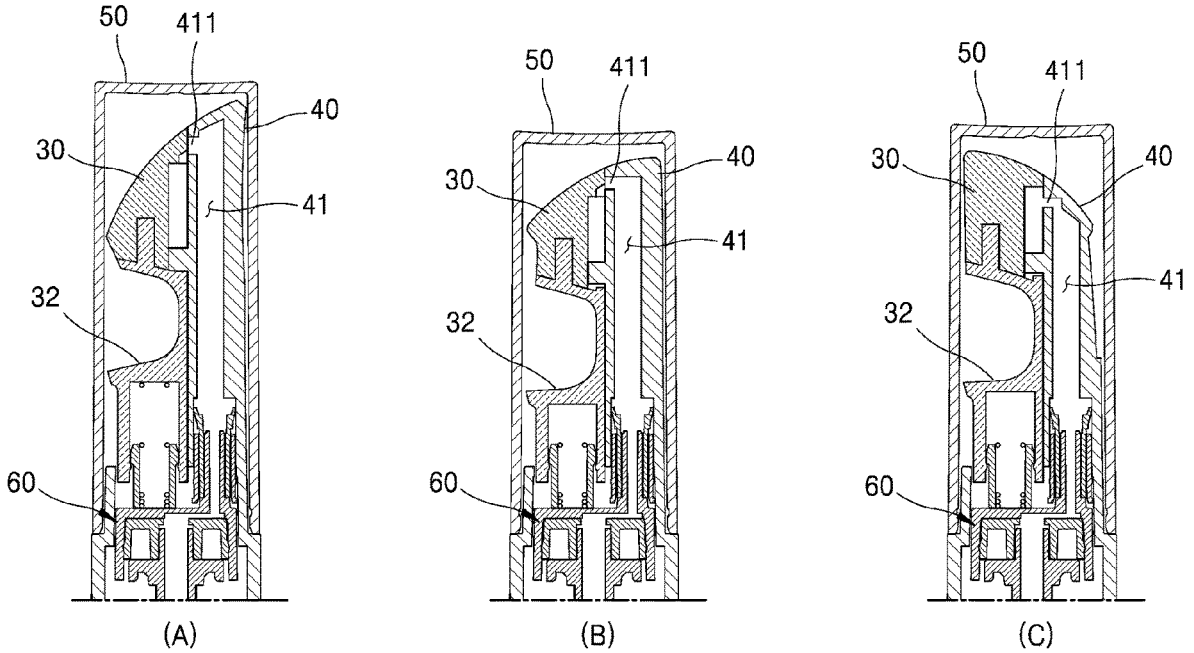
FIGS. 12A to 12C are sectional views showing the various types of liquid discharging vessels according to the second embodiment of the present invention.

FIG. 11 is a partially exploded perspective view showing the liquid discharging vessel according to the second embodiment of the present invention, and FIGS. 12A to 12C are sectional views showing the various types of liquid discharging vessels according to the second embodiment of the present invention.

Referring to FIGS. 11 to 12C, the pump 60 serves to discharge the content and has a vessel coupling part 61, a housing 62, a stem 63, a seal cap 64, a shaft 65, an under cap 66, and an ascending and descending part 67.

The vessel coupling part 61 is coupled to the spout 11 of the vessel body 10 to fix the housing 62 to the spout 11, and otherwise, it is coupled to the inner periphery of the shoulder 20 in such a manner as to surround the spout 11.

The vessel coupling part 61 is coupled to the spout 11, the shoulder 20, and the housing 62 by means of forced fitting or protrusion/groove coupling, but of course, they are coupled to each other, without specific limitation in their coupling ways. In this case, however, the vessel coupling part 61 serves to fix the housing 62 to a given position of the vessel body 10 and to ascendably and descendably guide the stem 63 and the shaft 65 at the inside thereof.

The vessel coupling part 61 has an elastic member (not shown) adapted to provide an elastic force against the shaft 65 as will be discussed later. The elastic member is a spring or the like. A lower end periphery of the elastic member is seated onto a top concave groove (having no reference numeral) formed on the vessel coupling part 61, and an upper end periphery of the elastic member is seated onto an underside concave groove (having no reference numeral) formed on the shaft 65, so that if a force pressurizing the button 32 disappears, the shaft 65 is naturally ascended to return the application tip 30 to its original state.

The housing 62 is coupled to one side open of the vessel body 10. The housing 62 has an inlet (having no reference numeral) formed on the underside surface toward the interior of the vessel body 10 and a backflow prevention valve 621 disposed on the inlet.

An internal pressure of the housing 62 is raised by the descending operation of the seal cap 64 to allow the content in the housing 62 to be discharged through the nozzle 40, and contrarily, the internal pressure of the housing 62 is lowered by the ascending operation of the seal cap 64 to allow the content in the interior of the vessel body 10 to be introduced into the housing 62. The operations will be in detail explained below.

The stem 63 is ascended and descended in the housing 62 and has an inlet 631 formed on one side thereof. The stem 63 is hollow, and an interior of the stem 63 communicates with the inlet 631 formed on one side of the stem 63.

The seal cap 64 is disposed around the inlet 631 of the stem 63, and as the seal cap 64 is ascended with respect to the stem 63, accordingly, the inlet 631 is open to allow the interior of the stem 63 to communicate with the interior of the housing 62.

The seal cap 64 comes into close contact with the inner peripheral wall of the housing 62 in such a manner as to open and close the inlet 631. The seal cap 64 is not descended by means of a frictional force against the inner peripheral wall of the housing 62 in processes where the application tip 30 is descended by the button 32 and the stem 63 is also descended, so that it is ascended to open the inlet 641.

Contrarily, if the shaft 65 is ascended by the elastic member, the stem 63 connected to the shaft 65 is ascended, but the seal cap 64 is not ascended by means of the frictional force against the inner peripheral wall of the housing 62, so that it is descended to close the inlet 641.

The shaft 65 is ascended unitarily together with the stem 63 to allow the seal cap 64 to be descended. The shaft 65 may be located between the stem 63 and the ascending and descending part 67, and for example, the shaft 65 is located between the stem 63 and the under cap 66 as will be discussed later.

The shaft 65 is descended if the button 32 is pressed, and the shaft 65 is coupled to the stem 63, so that if the shaft 65 is descended, the stem 63 is accordingly descended. Further, the lower end periphery of the shaft 65 pushes the seal cap 64 downwardly.

The shaft 65 includes a ring edge 651 having the underside concave groove for sealing the elastic member thereonto, and the shaft 65 has the upward elastic force applied from the elastic member, so that if the force pressurizing the button 32 disappears, the shaft 65 is ascended by the elastic force of the elastic member.

According to the second embodiment of the present invention, the stem 63 and the shaft 65 are provided separately from each other. This is because an outer diameter of the lower end periphery of the shaft 65 is larger than an inner diameter of the seal cap 64, and after the seal cap 64 is fitted to the stem 63, accordingly, the shaft 65 is coupled to the stem 63.

The under cap 66 serves to connect the shaft 65 and the ascending and descending part 67 with each other. The under cap 66 couples the shaft 65 to the ascending and descending part 67 by means of a protrusion/groove structure, and the content is distributed on top of the under cap 66 and is thus introduced into the flow path 41 of the nozzle 40.

The ascending and descending part 67 serves to descend the stem 63 through the descending operation of the application tip 30. The ascending and descending part 67 has a tip coupling member 671 inserted into the application tip 30, so that the application tip 30 can be ascended with respect to the tip coupling member 671, and the tip coupling member 671 has an elastic member (not shown) adapted to push the button 32 upwardly.

Accordingly, the application tip 30 does not descend the ascending and descending part 67 when it is primarily descended, but the application tip 30 is descended with respect to the nozzle 40 to allow the outlet 411 of the nozzle 40 to be exposed to the outside. When the application tip 30 is secondarily descended, after that, it pushes the ascending and descending part 67 downwardly to allow the stem 63 to be descended.

The ascending and descending part 67 has a nozzle insertion member 672 inserted into the nozzle 40 and an inner tube 673 and an outer tube 674 disposed around the nozzle insertion member 672. The nozzle 40 is formed unitarily with the shoulder 20 and is not descended, but the ascending and descending part 67 is descended by the secondary descending operation of the application tip 30, so that the nozzle insertion member 672 is descended with respect to the nozzle 40.

So as to prevent the content from leaking to the space between the ascending and descending part 67 and the nozzle 40, at this time, the ascending and descending part 67 has the inner tube 673 enlarged toward the upper side in such a manner as to come into close contact with the inner periphery of the flow path 41 and the outer tube 674 sliding upwardly and downwardly along the inner tube 673.

If the ascending and descending part 67 is descended, for example, the inner tube 673 is ascended with respect to the nozzle insertion member 672 and/or the outer tube 674 like a telescopic structure by means of a frictional force against the inner periphery of the flow path 41, and accordingly, the content is introduced just into the flow path 41 through the nozzle insertion member 672, so that it does not leak to the gap between the ascending and descending part 67 and the shoulder 20.

In addition to the inner tube 673 and the outer tube 674 of the nozzle insertion member 672, of course, various structures may be adopted if it is possible to prevent the leakage of the content. That is, the inner tube 673 or the outer tube 674 may be not provided.

Hereinafter, an explanation on a method for using the liquid discharging vessel according to the second embodiment of the present invention will be in detail given with reference to FIGS. 13 to 16.

FIGS. 13 to 16 are sectional views showing use states of the liquid discharging vessel according to the second embodiment of the present invention.

Figure 13:
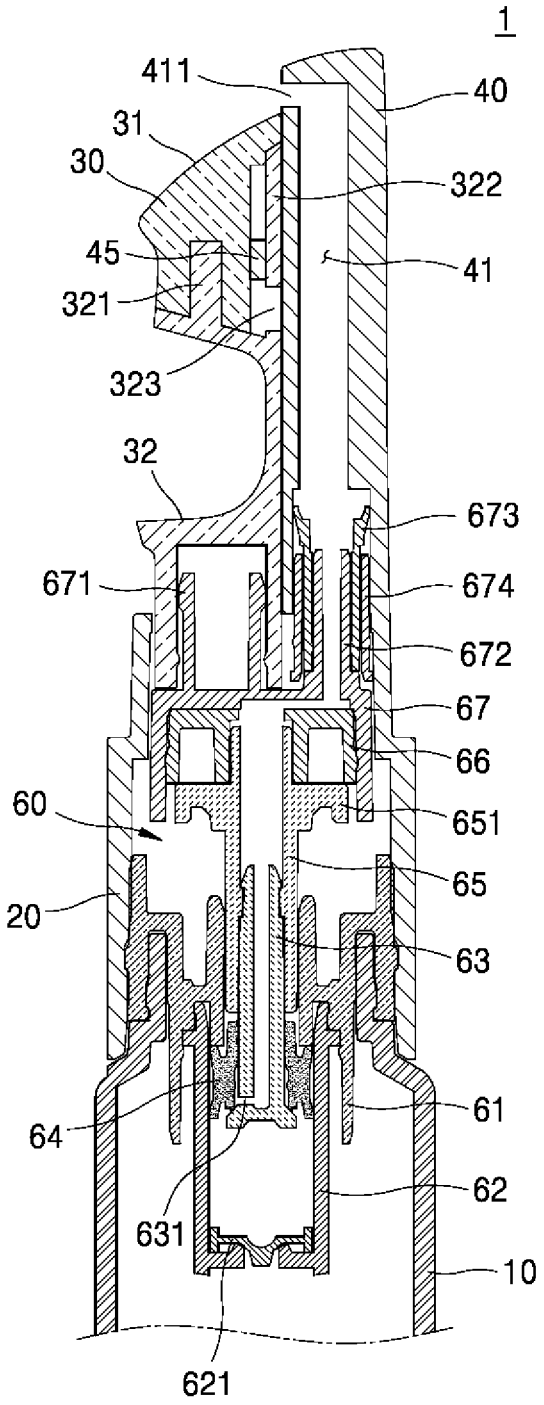
FIG. 13 is a sectional views showing a use state of the liquid discharging vessel according to the second embodiment of the present invention.

Referring to FIG. 13, if the button 32 is pressed by the user's finger, the elastic member fitted to the tip coupling member 671 is compressed, so that the application tip 30 is primarily descended and the ascending and descending part 67 is not descended.

At this time, however, the outlet 411 of the nozzle 40 is exposed to the outside above the top of the application tip 30, so that the content is ready to be transferred to the application surface 31. As the inlet 631 of the flow path 41 of the nozzle 40 is closed, however, it is kept isolated from the interior of the housing 62.

Figure 14:
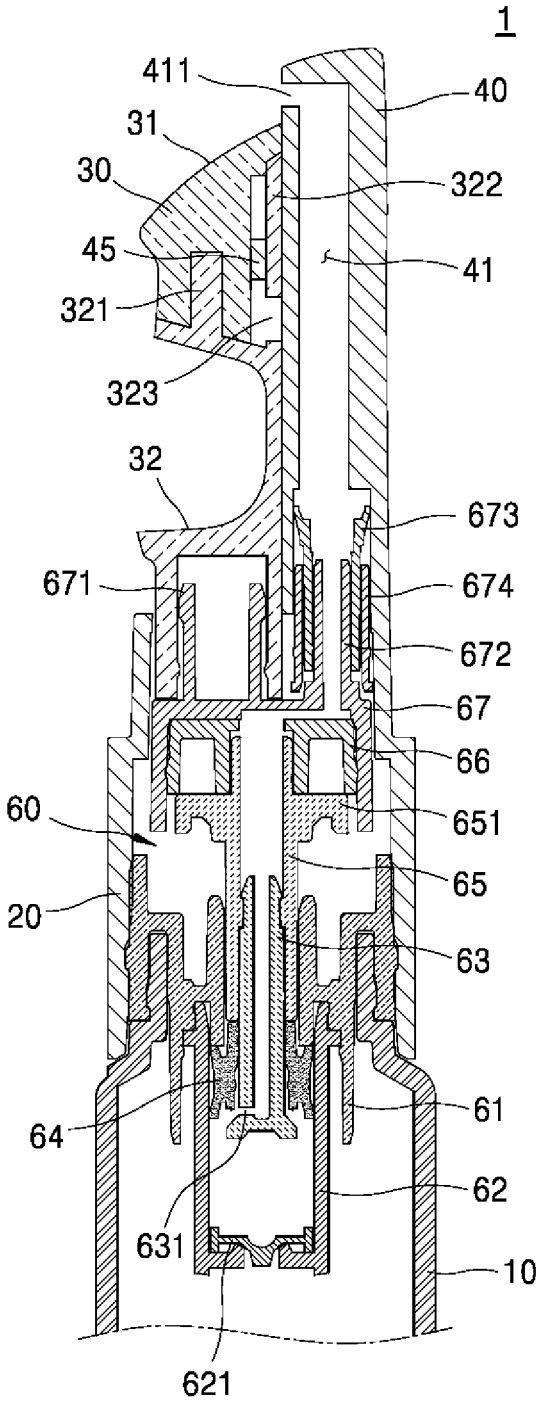
FIG. 14 is a sectional views showing another use state of the liquid discharging vessel according to the second embodiment of the present invention.

Referring to FIG. 14, if the button 32 is pressed again, the application tip 30 is secondarily descended to allow the ascending and descending part 67 to be descended, and at this time, the under cap 66, the shaft 65, and the stem 63, which are connected to the ascending and descending part 67 are descended together with the ascending and descending part 67. As the seal cap 64 is not descended by means of the frictional force, however, the inlet 631 of the stem 63 is open to allow the interior of the housing 62 to communicate with the flow path 41.

Figure 15:
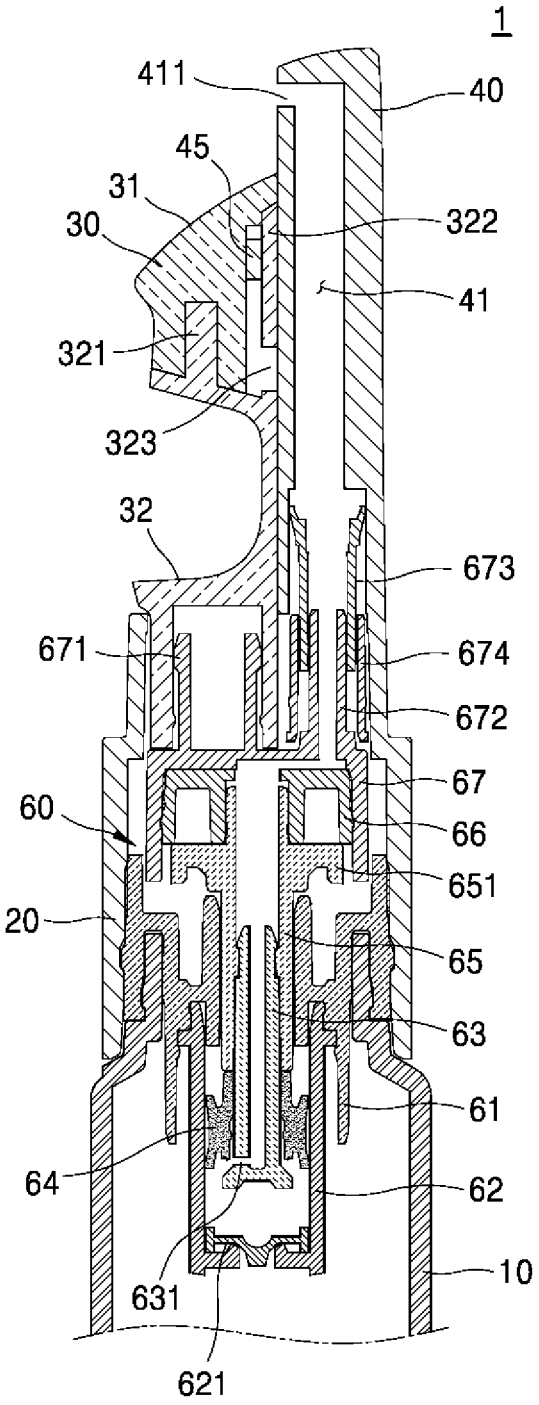
FIG. 15 is a sectional views showing yet another use state of the liquid discharging vessel according to the second embodiment of the present invention.

Referring to FIG. 15, after that, if the application tip 30 is secondarily descended, the seal cap 64 moves downwardly by means of the lower end periphery of the shaft 65 to raise an internal pressure of the housing 62. Accordingly, the content in the housing 62 is discharged through the interior of the shaft 65, the top of the under cap 66, the nozzle insertion member 672, and the flow path 41 to the outlet 411 and is then transferred to the application surface 31.

As shown in FIGS. 14 and 15, the nozzle 40 is kept fixed to the shoulder 20, and as the application tip 30 is descended, accordingly, the outlet 411 is located higher than the application surface 31. Through appropriate selection in the viscosity of the content, however, the content discharged from the outlet 411 located higher than the application surface 31 above the application surface 31 is transferred to the application surface 31, without any trouble.

Further, as mentioned above, the nozzle 40 may be descendable from the shoulder 20, and in this case, the nozzle 40 is ascendably and descendably coupled unitarily with the ascending and descending part 67.

Figure 16:
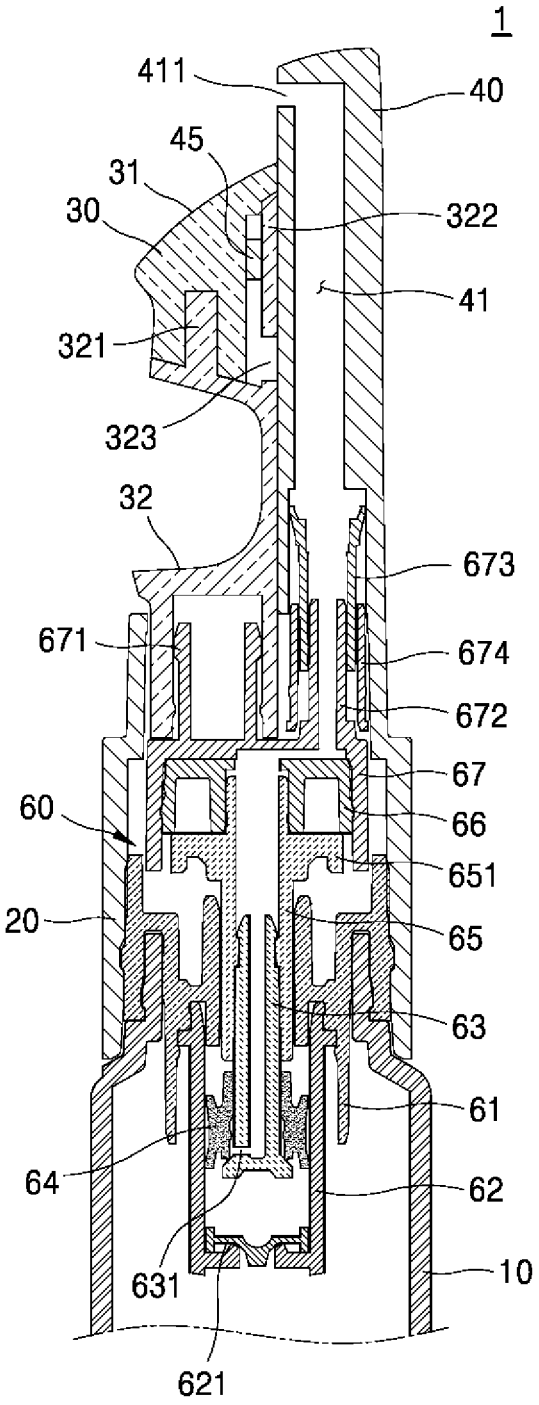
FIG. 16 is a sectional views showing still another use state of the liquid discharging vessel according to the second embodiment of the present invention.

Referring to FIG. 16, if the pressurizing force against the button 32 disappears, the stem 63 is ascended by the elastic member disposed between the vessel coupling member 61 and the shaft 65, and the seal cap 64 descended with respect to the stem 63 closes the inlet 631 of the stem 63.

If the stem 63 is further ascended, after that, the lower end periphery of the stem 63 pushes the seal cap 64 upwardly, and accordingly, the internal pressure of the housing 62 is lowered to allow the content stored in the vessel body 10 to be introduced into the housing 62 and thus filled therein.

As a series of operations as mentioned above are repeatedly performed, the application tip 30 is descended to pump the content, thereby permitting the content to be transferred to the application surface 31 through the outlet 411 of the nozzle 40 located above the application surface 31.

According to the present invention, further, the application tip 30 is descended to allow the outlet 411 of the nozzle 40 to be open or closed, so that through the operation of the application tip 30, it is convenient to apply the content, and through the opening and closing of the outlet 411, sanitation can be ensured.

As described above, the liquid discharging vessel according to the present invention has the application tip adapted to allow the content to be directly transferred to the application portion and has the nozzle relatively ascended and descended with respect to the application tip and having the outlet, which is not formed on the top of the application tip, so that even if the application tip rubs against the application portion, the introduction of the foreign matters into the outlet can be perfectly prevented.

In addition, the liquid discharging vessel according to the present invention is capable of allowing the outlet to be kept closed by the relative ascending and descending operations of the application tip and the nozzle to each other, so that even if a separate cap is not provided or the cap is unexpectedly taken off, the leakage of the content can be prevented to enhance the user's satisfaction.

The present invention includes an embodiment where known technology is combined to at least any one of the first and second embodiments of the present invention and an embodiment where the first and second embodiments of the present invention are combined to each other.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The simple changes and modifications of the present invention are within the scope of the present invention, and the scope of the present invention will be clear by the claims appended hereto.

What is claimed is:

1. A discharging container comprising:

a vessel body having one upper side open and containing cosmetic content;

an application tip fixedly disposed on the one upper side of the vessel body and having a top; and a nozzle having an outlet configured to discharge the cosmetic content to the top of the application tip, the nozzle being movable away with respect to the vessel body to open the outlet and discharge the cosmetic content in an open position, wherein the outlet is closed and covered by a side of the application tip as the nozzle is moved closer with respect to the vessel body from the open position, and wherein the top of the application tip has a surface configured to be rubbed on a skin when the cosmetic content is discharged thereon.

2. The discharging container of claim 1, wherein the nozzle comprises a handle outwardly protruding therefrom to be used by a user for upward and downward movement of the nozzle.

3. The discharging container of claim 1, wherein the nozzle comprises a depressed portion defined on an external surface of the nozzle to receive a user's finger.

4. The discharging container of claim 1, wherein the top of the application tip has a downward inclined surface as a distant end portion of the top from the outlet being open has a smaller height than a height of a portion of the top adjacent to the outlet.

5. The discharging container of claim 1, wherein the application tip is comprised of at least one of a metal or ceramic material.

6. The discharging container of claim 1, further comprising:

a shoulder coupled to the one upper side of the vessel body and accommodating the application tip, wherein the nozzle comprises a flow path having the outlet disposed on one end thereof and transferring the cosmetic content from another end, and the shoulder comprises a discharger connecting an interior of the vessel body to the flow path of the nozzle.

7. The discharging container of claim 6, wherein the discharger comprises a discharge hole defined on the underside thereof, and the nozzle comprises a valve to open and close a space between the interior of the vessel body and the flow path by upward and downward movement of the nozzle.

8. The discharging container of claim 7, wherein the discharger comprises a protrusion disposed on the center of the underside thereof and the discharge hole defined around the protrusion, wherein the valve is hollow and is detachably fitted to the protrusion of the discharger and isolates the interior of the vessel body from the flow path, and when the valve is moved upward, the protrusion of the discharger is detached from the valve and the interior of the vessel body communicates with the flow path through the discharge hole.

9. The discharging container of claim 6, wherein the shoulder comprises a guide located between the application tip and the nozzle to guide upward and downward movement of the nozzle.

10. The discharging container of claim 1, wherein when the outlet is closed and covered by the side of the application tip, the top of the application tip and a top of the nozzle define a continuous and smooth surface.

11. The discharging container of claim 1, wherein the outlet is disposed on a side of the nozzle and is closed and covered by the side of the application tip when the nozzle is positioned closest with respect to the vessel body.

* * * * *